US005973664A

United States Patent [19]

Badger

[11] Patent Number: 5,973,664

[45] Date of Patent: Oct. 26, 1999

[54] PARAMETERIZED IMAGE ORIENTATION FOR COMPUTER DISPLAYS

[75] Inventor: Alan E. Badger, Pleasanton, Calif.

[73] Assignee: Portrait Displays, Inc., Pleasanton, Calif.

[21] Appl. No.: 09/045,063

[22] Filed: Mar. 19, 1998

[51] Int. Cl.[6] ..... G09G 5/34

[52] U.S. Cl. ..... 345/126; 345/511; 382/297

[58] Field of Search ..... 345/126, 511, 345/515, 516, 437; 382/297

[56] References Cited

U.S. PATENT DOCUMENTS

| | | | |
|---|---|---|---|
| 4,225,929 | 9/1980 | Ikeda | 364/521 |
| 4,267,555 | 5/1981 | Boyd et al. | 340/748 |
| 4,542,377 | 9/1985 | Hagen et al. | 340/727 |
| 4,635,212 | 1/1987 | Hatazawa | 364/518 |
| 4,806,920 | 2/1989 | Sawada | 340/727 |
| 4,831,368 | 5/1989 | Masimo et al. | 340/720 |
| 4,947,344 | 8/1990 | Hayashi et al. | 364/518 |
| 4,952,920 | 8/1990 | Hayashi | 345/126 |
| 5,034,733 | 7/1991 | Okazawa et al. | 382/297 |
| 5,134,390 | 7/1992 | Kishimoto et al. | 345/126 |
| 5,189,404 | 2/1993 | Masimo et al. | 340/720 |
| 5,329,289 | 7/1994 | Sakamoto et al. | 345/126 |
| 5,434,964 | 7/1995 | Moss et al. | 395/157 |
| 5,533,185 | 7/1996 | Lentz et al. | 345/524 |
| 5,774,233 | 6/1998 | Sakamoto | 358/451 |

OTHER PUBLICATIONS

Dudrow, A., "New Displays from NEC, Mitsubishi", MacWEEK, Apr. 6, 1998, http:\\www.zdnet.com\zdnn\content\macw\1213\304611.html.

Press Releases, NEC Technologies' Newest Line of Multisync® LCR Monitors Emphasizes Versatility, Ease of Use, Itasca, IL, Mar. 30, 1998, http:\\www.nec.com\company\RecentPR\980330z.html.

PCTODAY Processor, XGA LCDs, CTX vs. Princeton vs. Smile vs. Panasonic vs. ViewSonic vs. Nokia vs. Akia vs. Compaq, Mar., 1998 Issue, http:\www.pctoday.com\editorial\hth\980326.html.

*Primary Examiner*—Kee M. Tung
*Attorney, Agent, or Firm*—Fenwick & West LLP

[57] ABSTRACT

A system and method accommodate several image orientation modes in a single software driver. The driver utilizes the same software instructions for each orientation mode in order to transfer image information to display memory. The driver instructions which transfer the image information to display memory utilize parameters to determine where each successive pixel of information goes in the display memory. These parameters are set at the time an orientation mode is selected, and the use of these parameters by the driver allows the same instructions to be used for each mode.

24 Claims, 8 Drawing Sheets

Orientation Modes

PARAMETERIZED IMAGE ORIENTATION FOR COMPUTER DISPLAYS

FIELD OF INVENTION

This invention pertains to the field of computer displays. More specifically, this invention pertains to a parameterized method of rotating an image on a computer display.

BACKGROUND OF THE INVENTION

Conventional computer display screens typically are oriented in a landscape format in which the screen image is wider than it is tall. While this format is convenient for many computer applications, it is inconvenient for others. A computer display screen which is oriented in a landscape format is less desirable for viewing an image of a typical document which is taller than it is wide. Although conventional landscape computer displays can display an image of a document which is taller than it is wide, they do so by wasting display space on the sides of the image. Given the steep increase in the price of computer displays with larger display areas, this wasted space is not economical.

In order to accommodate computer users who may wish to utilize a single monitor for both landscape and portrait (taller than wide) viewing, rotatable computer displays have been developed. A rotatable computer display can be rotated about an axis that is substantially perpendicular to the plane of the display screen. In order for an image on a rotated computer display to appear upright, however, the attached computer needs to modify the image sent to the computer display. For rotatable computer displays to be useful, a computer must be able to change the orientation of the image transmitted to the display to compensate for rotation of the display.

The ability to alter the orientation of an image sent to a computer display is also advantageous in circumstances other than rotatable displays. For example, if the display is a flat panel display which is lying on a table, it may be viewed by people at the table from many different directions. By changing the orientation of an image on the display, more people at the table may be accommodated in viewing an image.

Conventionally, a computer facilitates display image orientations with a number of orientation modes, each of which corresponds to a particular orientation of the image to be displayed, and the operating system keeps track of the current orientation mode. The mode might be set by a user through a standard user interface dialog box, or it could be set by the operating system in response to a sensor on the computer monitor indicating the current rotation of the monitor. The computer typically uses a software switch to invoke program code specific to the current orientation mode. The program code invoked modifies image information before putting it into a display memory in such a way as to produce the desired orientation of the image on the computer display. The code used to effect the orientation of an image in one mode is not used to effect the orientation of an image in another mode.

Because each orientation mode is associated with code which is specialized for that mode, the software becomes larger with an increased number of available modes. Larger code takes up more useful space on computers, and is generally more difficult to maintain, so the number of modes accommodated by conventional computer systems is often limited to a few orientation modes.

What is needed is a computer system which can accommodate different orientation modes by using the same code to transfer and modify image information for each mode. This would result in a reduction of code required, and would allow more orientation modes to be accommodated.

SUMMARY OF THE INVENTION

In one embodiment of the present invention, a method is provided for modifying an image, if necessary, to conform to a selected orientation. Any modification to the image takes place while the image is being transferred from a source memory to a display memory. A computer display presents to a user the image as it is stored in the display memory after the transfer. As an example, possible selected orientations can include rotations of 0 degrees, 90 degrees, 180 degrees and 270 degrees, and a "mirror" version of each of these orientations, in which the images are reflected about the axis of the image which would be vertical in the absence of rotation.

Two increment parameters, an X_Increment parameter and a Y_Increment parameter, are calculated from the selected orientation. These parameters are used during the image transfer to effect any necessary change to the image orientation, in order to ensure that the image as stored in the display memory, and as presented on the computer display, corresponds to the selected orientation.

The image to be transferred is made up of a series of image lines, and each image line is made up of a series of pixels. Similarly, the display memory is made up of an array of memory locations which correspond to a series of display lines, which display lines are each made up of a series of pixels. The image is transferred to the display memory by taking each pixel of each line from the source memory and putting it in the display memory at a location specified by a display memory pointer. The display memory pointer indicates a particular pixel location in the display memory, and the display memory pointer is updated after each pixel is transferred, so that each pixel is placed at the proper pixel location in the display memory. After all pixels of a single image line are transferred, the value of the X_Increment parameter is added to the display memory pointer. After each line is finished, the value of the Y_Increment parameter is added to the display memory pointer.

By setting the values of the X_Increment and Y_Increment parameters appropriately, the orientation of the image in the display memory can be determined. For example, in one embodiment, where no change in the orientation of the image is necessary, the X_Increment parameter would be set to a value equal to the memory size of a single pixel in the display memory, and the Y_Increment parameter would be set to equal the memory size of a single display line in the display memory minus the product of the number of pixels in a single image line multiplied by the memory size of a single pixel in the display memory. When a different orientation is selected, the X_Increment and Y_Increment parameters are changed to accommodate the selected orientation.

In other embodiments of the invention, the act of transferring a pixel from the source memory to the display memory can include more than just copying the contents of the source memory location to the appropriate display memory location. For example, the pixel value could undergo a logical operation with respect to pixel values in a mask image. The pixel value could also be logically combined with the value being replaced in the display memory.

In another embodiment, a system for presenting an image on a computer display such that the image conforms in orientation to one of a plurality of selectable orientations with respect to the computer display is provided.

A software product is provided in another embodiment. The software product includes a computer-readable medium which stores program code for transferring image information from a source memory to a display memory for presentation on a computer display in conformity with one of a plurality of selectable orientations with respect to the computer display.

DETAILED DESCRIPTION OF THE PREFERRED EMBODIMENTS

Figure 1:
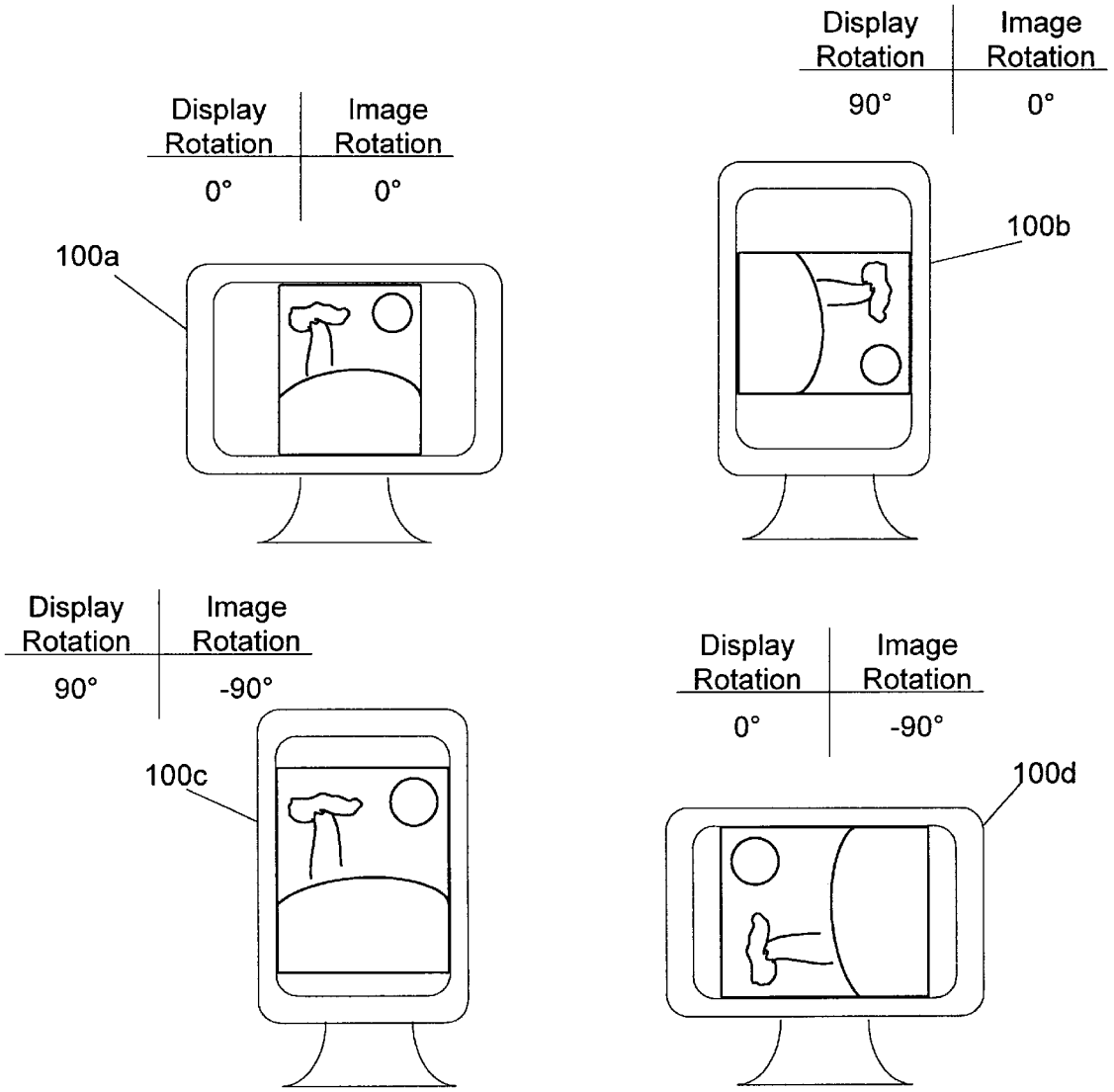
FIG. 1 is an illustration of rotatable computer displays 100.

FIG. 1 illustrates the modification of an image which is necessary before it is sent to a rotated computer display. Computer display 100*a* is oriented in standard landscape mode, displaying an image which is taller than it is wide. The space on either side of the image is wasted. The user of rotatable display 100*a* can rotate it 90 degrees clockwise, which would result in computer display 100*b*. The image on display 100*b* appears rotated 90 degrees, however, because of the rotation of the display. In order to view the image upright as on rotated display 100*c*, the computer must compensate for the clockwise rotation of the display by sending to the display an image which is rotated 90 degrees in the counterclockwise direction. The image sent by the computer to display 100*c* would look like that on display 100*d* if the display were left in the standard landscape orientation.

Figure 2:
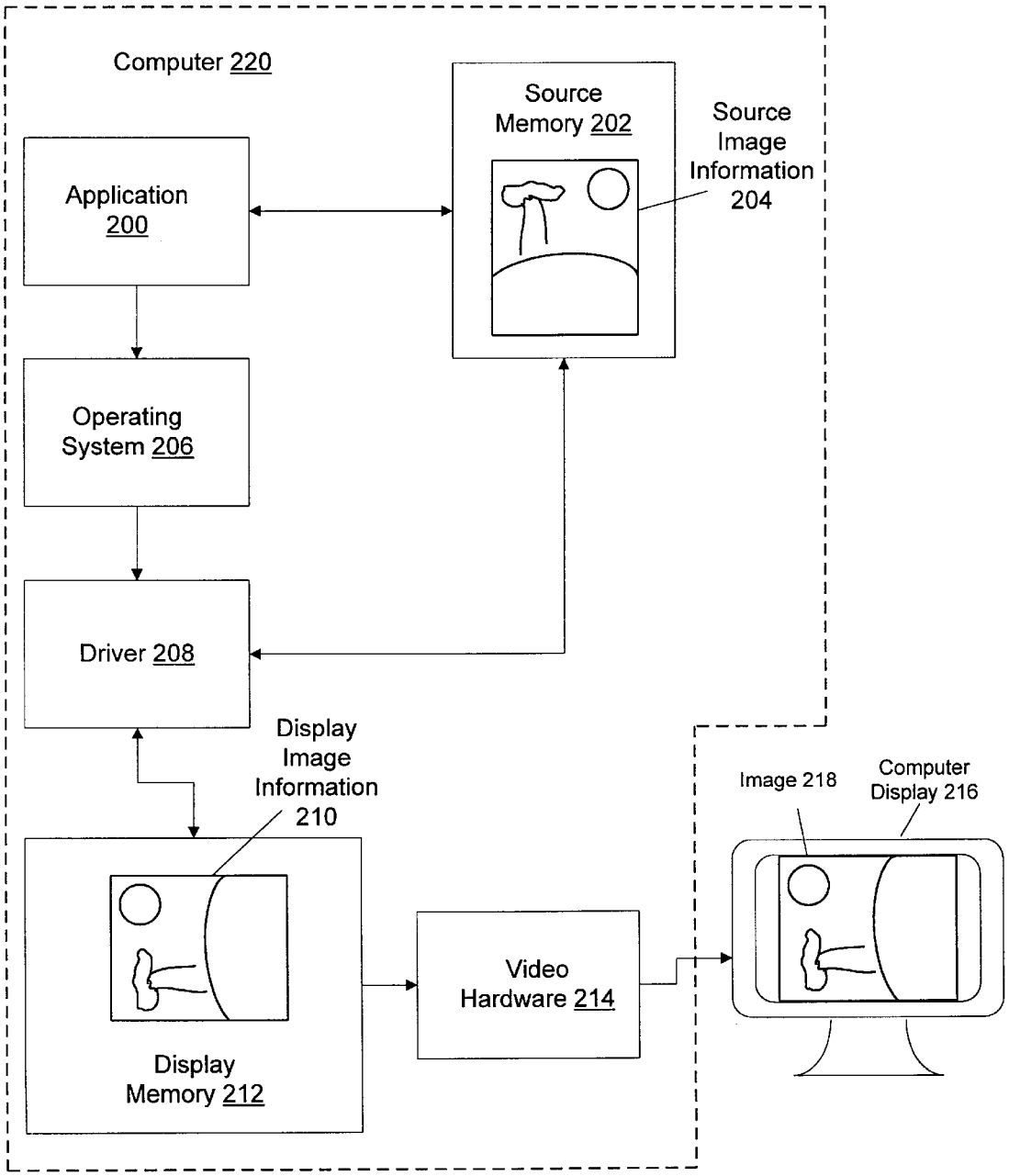
FIG. 2 is an illustration of computer system 220 embodying the present invention.

An illustrative embodiment of the present invention is illustrated in FIG. 2. Computer display 216 exhibits image 218 based on display image information 210 stored in display memory 212 which is accessible by computer 220. This display memory 212 is organized into arrays of memory cells, and the organization of information in display memory 212 takes the form of contiguous blocks of memory which each represent a single horizontal line of pixels on the display. Video hardware 214 uses display image information 210 in display memory 212 to generate display signals for computer display 216. The appearance of image 218 on computer display 216 is determined by the organization of information 210 placed in display memory 212. When software application 200, such as a word processor or a drawing program, needs to put an image 204 on display screen 216, it typically places image information 204 in source memory 202. Application 200 then signals operating system 206 that image 204 in source memory 202 needs to be put on display screen 216. Operating system 206 then communicates this information to driver 208. Driver 208 is a small software program which performs the task of retrieving source image information 204 from source memory 202 and putting it into display memory 212. If any modifications to the orientation of image 204 are necessary, driver 208 performs these modifications while writing display image information 210 to display memory 212. Driver 208 performs all modifications to image 204 using a single parameterized method of operation that can be used to rotate image 204 for any of a number of orientation modes.

Figure 3:
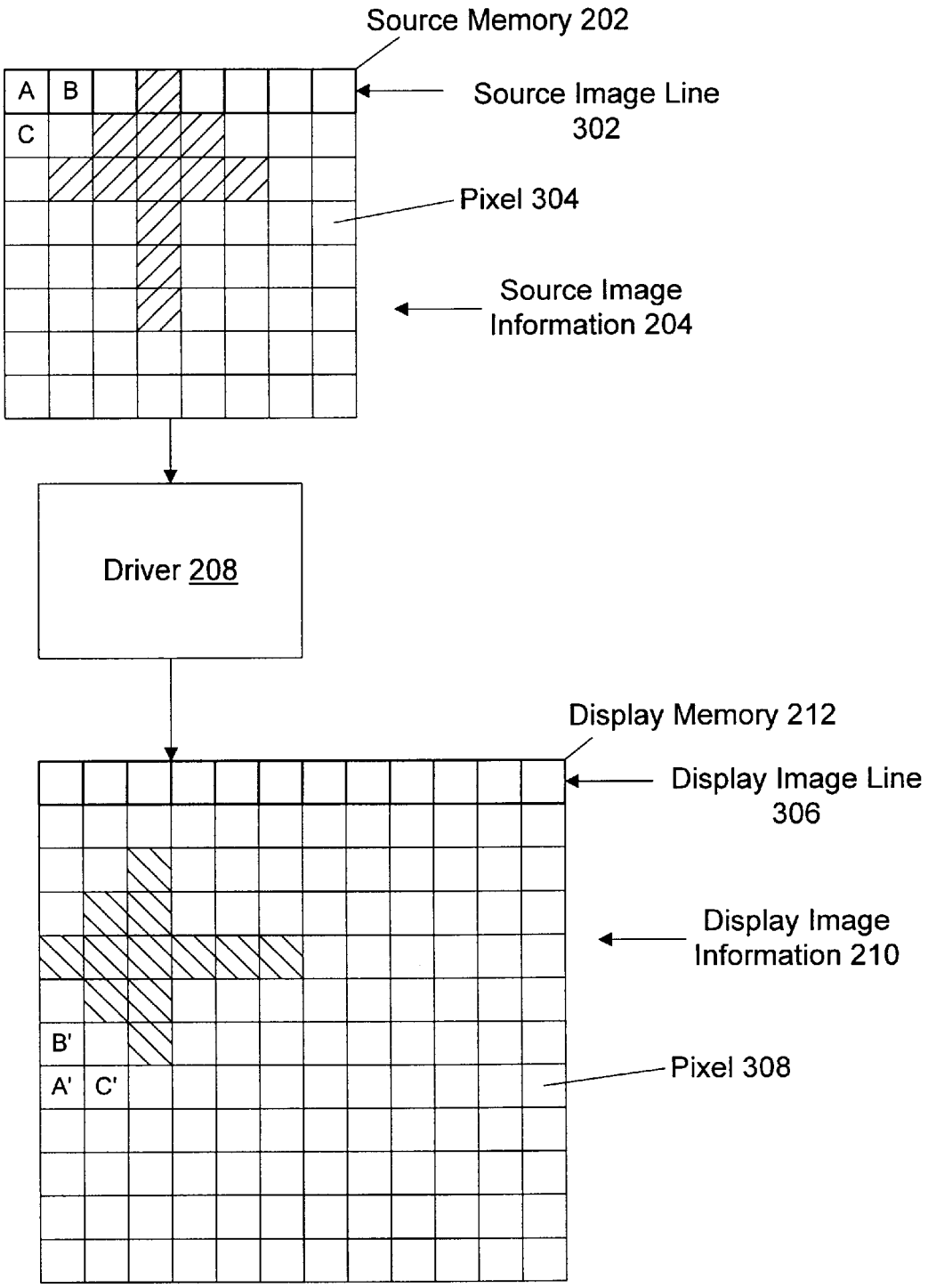
FIG. 3 is an illustration of the relation of source memory 202 to display memory 212.

Referring now to FIG. 3, image 210 to be shown on computer display 216 is in the form of an array of display image lines 306, with each display image line 306 being an array of pixels 308. Driver 208 transfers image 204 line by line, pixel by pixel from source memory 202 to display memory 212. Computer display 216 shows what is in display memory 212, and driver 208 can change the orientation of displayed image 218 by changing the ordering of pixels 308 of image 210 in display memory 212. In FIG. 3, an image of an arrow is shown in source memory 202. Display memory 212 contains an image of the same arrow rotated counterclockwise 90 degrees. The mapping of pixels 304 from source memory 202 to display memory 212 is illustrated by the three pixels marked A, B, and C, which are mapped to the three pixels 308 marked A', B', and C'.

When a user wishes to change the orientation of images 218 on computer display 216, the user makes a selection of one of a variety of possible orientation modes. When this selection occurs, driver 208 is notified, and a setup procedure begins so that images 218 later drawn to computer display 216 will have the desired orientation. This setup procedure involves using information about the desired orientation to calculate two increment parameters, X_Increment and Y_Increment. The X_Increment parameter indicates the difference in display memory 212 between pixels 308 which correspond to adjacent pixels 304 of the same source image line 302 in source memory 202. For example, pixels A and B are adjacent pixels 304 of the same source image line 302 in FIG. 3. For display image 210, the values of these two pixels 304 are transferred to A' and B' in display memory 212. The difference in memory addresses between A' and B' in display memory 212 is the X_Increment parameter. The Y_Increment parameter is the difference in display memory 212 between pixels 308 which correspond to adjacent pixels 304 of different source image lines 302 in source memory 202. For display image 210, pixels A' and C' correspond to pixels A and C of source memory 202, A and C being adjacent pixels 304 of different source image lines 302 in source memory 202. The difference in memory addresses between A' and C' in display memory 212 is the Y_Increment parameter.

When driver 208 is notified that image 204 is to be displayed on computer display 216, driver 208 invokes a set of software instructions to transfer image information 204 from source memory 202 into display memory 212 using the X_Increment and Y_Increment parameters, which are modified depending on the desired orientation mode. As each pixel 304 in a source image line 302 is transferred from source memory 202 to display memory 212, driver 208 determines the new pixel 308 location in display memory 212 by adding the X_Increment parameter to the location of the previous pixel 308 from that source image line 302. Each time a new source image line 302 is begun, the Y_Increment parameter is added to the location in display memory 212 of the first pixel 308 of the previous source image line 302. After the location in display memory 212 of the first pixel is determined, the location in display memory 212 of each subsequent pixel can be determined from the two increment parameters. In this way, the same set of instructions can effect the transfer of image information 204 regardless of which orientation mode selected, merely by changing the values of the X_Increment and Y_Increment parameters according to the selected orientation mode.

Figure 4:
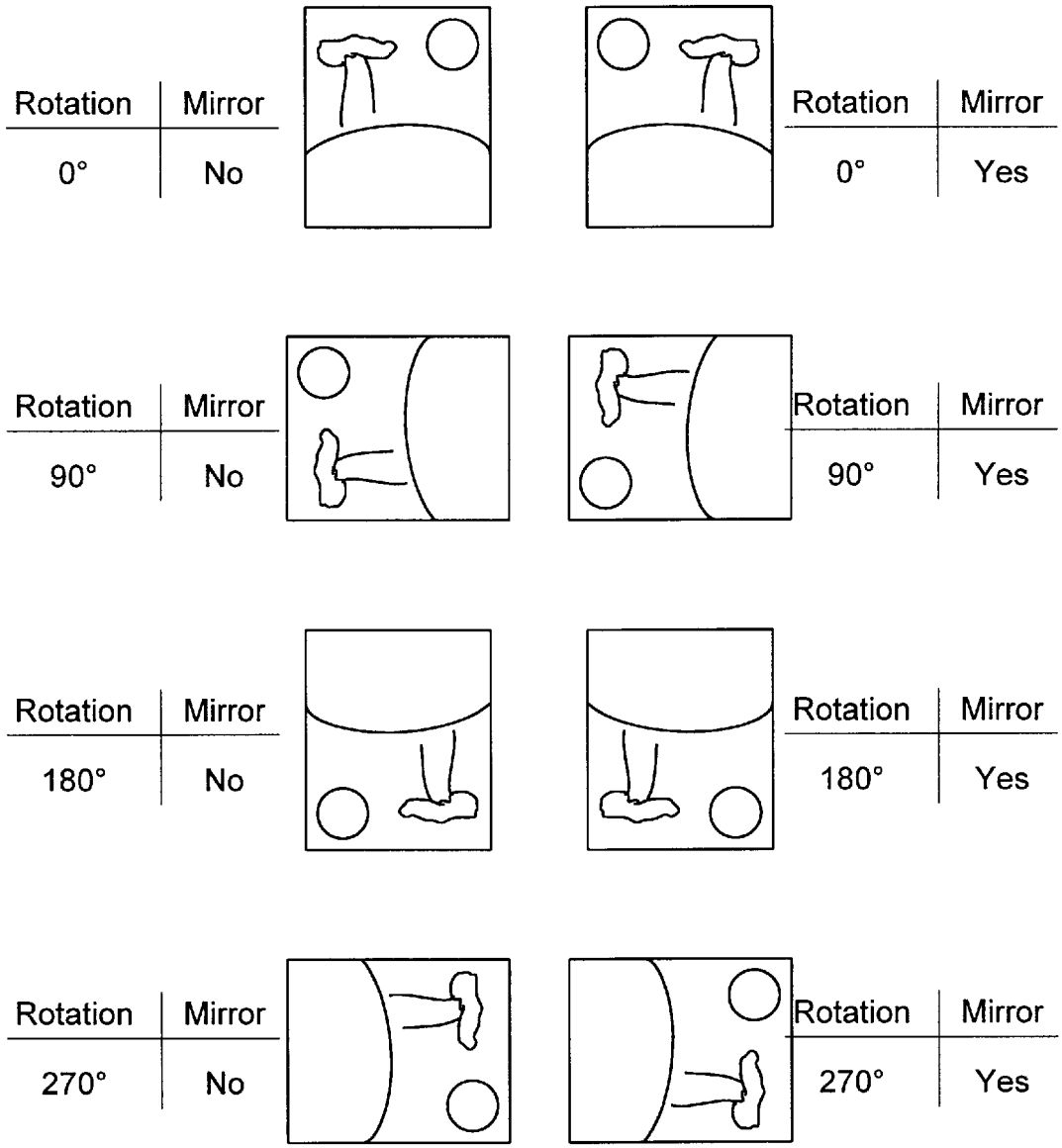
FIG. 4 is an illustration of the eight orientation modes of the illustrative embodiment.

As illustrated in FIG. 4, a number of orientations of image 204 are accommodated in the present invention. Orientation modes of the illustrative embodiment of the present invention include rotations of 0 degrees ("standard mode"), 90 degrees, 180 degrees and 270 degrees, and a "mirror" version of each of these modes, in which the images are reflected about the axis of the image which would be vertical in the absence of rotation. The values for the X_Increment and Y_Increment parameters associated with each combination of rotation and mirror mode is set out in Table 1.

TABLE 1

| Rotation | Mirror | X_Increment | Y_Increment |
|---|---|---|---|
| 0° | No | Display Pixel Width | Display Line Width |
| 0° | Yes | - Display Pixel Width | Display Line Width |
| 90° | No | - Display Line Width | Display Pixel Width |
| 90° | Yes | Display Line Width | Display Pixel Width |
| 180° | No | - Display Pixel Width | - Display Line Width |
| 180° | Yes | Display Pixel Width | - Display Line Width |
| 270° | No | Display Line Width | - Display Pixel Width |
| 270° | Yes | - Display Line Width | - Display Pixel Width |

Because driver 208 does not use a separate set of software instructions for each orientation mode, driver 208 can be smaller and less complex than conventional drivers for achieving the same result.

A user of computer system 220 selects the desired orientation mode through a standard operating system 206 user interface dialog box. In an alternate embodiment, computer display 216 can include a sensor which determines the current physical orientation and signals operating system 206 to change the orientation mode to compensate for the rotation.

Figure 5:
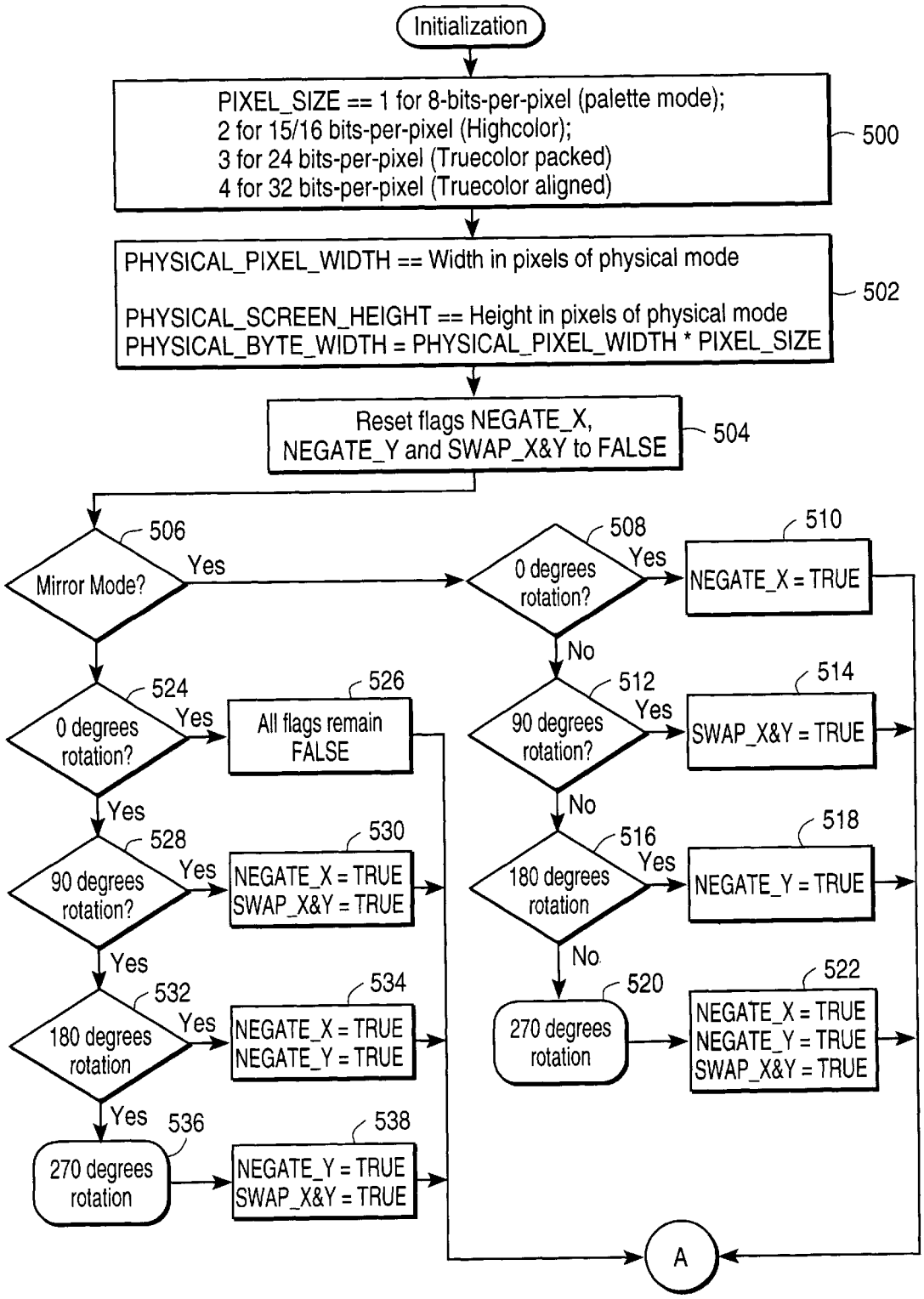
FIGS. 5–8 are a flowchart of the procedure followed by driver 208.
Figure 6:
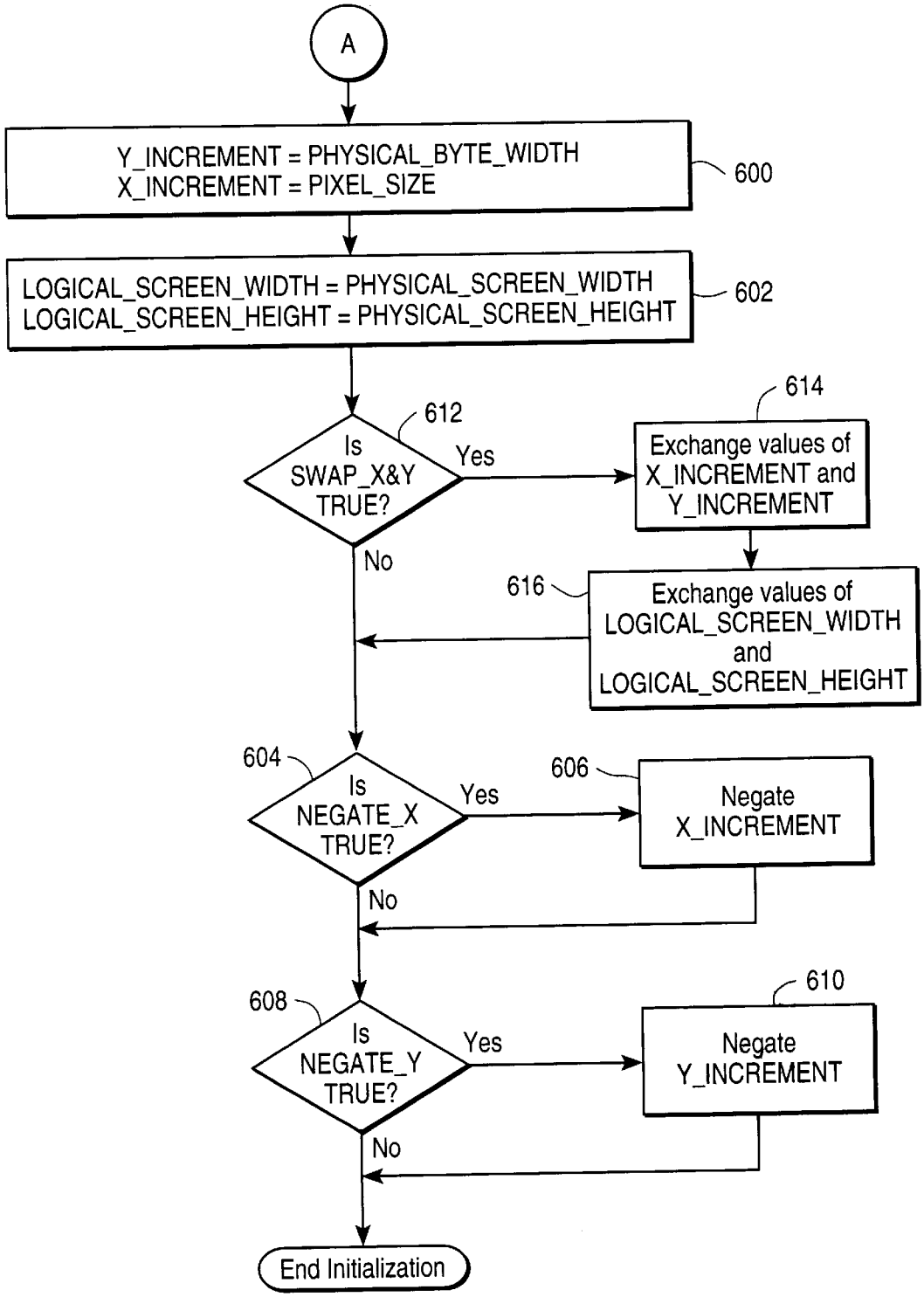

FIGS. 5 through 8 illustrate, in flowchart form, the method employed by driver 208. FIGS. 5 and 6 illustrate the initialization procedure carried out when either the orientation mode is changed or other properties of the display are altered. This initialization procedure sets certain parameters to values which accommodate the desired orientation of images 218 on computer display 216. First, a Pixel_Size parameter is set 500 to equal the number of bytes in display memory 212 required to represent a single pixel 308. Because the value of Pixel_Size is used by driver 208 in later calculations, this procedure needs to be executed whenever the color depth (the number of bytes per pixel 308) changes.

A Physical_Screen_Width parameter is then set 502 to equal the number of pixels 308 in one display image line 306 across computer display 216 (which display image line 306 is horizontal in standard mode). This value is determined by the resolution of the display mode in which computer display 216 is operating, and is not dependent on any rotation of computer display 216. For example, if the resolution is set to 1024 by 768 pixels, Physical_Screen_Width is 1024 regardless of orientation mode or computer display 216 rotation. Similarly, a Physical_Screen_Height parameter is set to the number of pixels making up a line across computer display 216 in the direction perpendicular to display image lines 306. A Physical_Byte_Width parameter is calculated as the product of Physical_Screen_Width and Pixel_Size, and represents the number of bytes in a single display image line 306 of computer display 216.

Next, three Boolean parameters, Swap_X&Y, Negate_X, and Negate_Y, are set 504 to false. These parameters are used later in the initialization routine. Swap_X&Y indicates whether the image is rotated such that the horizontal and vertical axes are exchanged. The Negate_X and Negate_Y parameters indicate whether the rotation and mirroring of the image result in the horizontal or vertical axes (after any exchanging of axes due to Swap_X&Y) being reversed in direction. Driver 208 then determines 506 whether the selected orientation mode is one of the mirror modes. If so, driver 208 determines 508 whether the orientation mode specifies no image 204 rotation. If so, Negate_X is set 510 to true, leaving the other Boolean parameters false. Otherwise, driver 208 determines 512 whether the orientation mode specifies 90 degrees of counterclockwise image 204 rotation. If so, driver 208 sets 514 Swap_X&Y to true, leaving the other Boolean parameters false. Otherwise, driver 208 determines 516 whether the orientation mode specifies 180 degrees of image 204 rotation. If so, driver 208 sets 518 Negate_Y to true, leaving the other Boolean parameters false. Otherwise, the rotation is assumed 520 to be 270 degrees counterclockwise, and Negate_X, Negate_Y, and Swap_X&Y are all set 522 to true.

If mirror mode is not set 506, driver 208 determines 524 whether the orientation mode specifies no image 204 rotation. If so, driver 208 leaves 526 all Boolean parameters false. Otherwise, driver 208 determines 528 whether the orientation mode specifies 90 degrees of counterclockwise image 204 rotation. If so, driver 208 sets 530 Negate_X and Swap_X&Y to true, leaving Negate_Y false. Otherwise, driver 208 determines 532 whether the orientation mode specifies 180 degrees of image 204 rotation. If so, driver 208 sets 534 Negate_X and Negate_Y to true, leaving Swap_X&Y false. Otherwise, driver 208 assumes 536 the rotation is 270 degrees counterclockwise, and driver 208 sets 538 Negate_Y and Swap_X&Y to true, leaving Negate_X false. The Boolean parameter settings for the eight orientation modes just described are restated in Table 2.

TABLE 2

| Rotation | Mirror | Negate_X | Negate_Y | Swap_X&Y |
|---|---|---|---|---|
| 0° | No | False | False | False |
| 0° | Yes | True | False | False |
| 90° | No | True | False | True |
| 90° | Yes | False | False | True |
| 180° | No | True | True | False |
| 180° | Yes | False | True | False |
| 270° | No | False | True | True |
| 270° | Yes | True | True | True |

Referring now to FIG. 6, following the setting of the Boolean parameters, an X_Increment parameter is set 600 to equal Pixel_Size, and a Y_Increment parameter is set 600 to equal Physical_Byte_Width. These values are appropriate for the standard display mode, but they need to be changed for the seven other orientation modes. The X_Increment parameter indicates the difference in addresses of display memory 212 for adjacent pixels 308 from the same source image line 302 in source memory 202. The Y_Increment parameter indicates the difference in addresses of display memory 212 for adjacent pixels 308 from a line in source memory 202 which is perpendicular to the lines 302.

Next, a Logical_Screen_Width parameter is set 602 equal to the Physical_Screen_Width parameter, and a Logical_Screen_Height parameter is set 602 equal to the Physical_Screen_Height parameter. In the case of some orientation modes, these values are correct, but for other orientation modes, these values are modified as described below. A "logical" screen is the computer display 216 screen as intended to be viewed by a user of computer display 216. If image 204 is rotated counterclockwise 90 degrees by driver 208, the logical screen intended to be seen by the user would be computer display 216 rotated clockwise 90 degrees. In other words, the logical screen is oriented such that, on the logical screen, image 218 appears to be oriented the same as image 204 in source memory 202. Logical_Screen_Height is the height in pixels of the logical screen, and Logical_Screen_Width is the width in pixels of the logical screen.

Logical_Screen_Width and Logical_Screen_Height are modified to account for the swapping of the horizontal and vertical axes due to 90 degrees or 270 degrees image rotation. Driver 208 determines 612 whether the Swap_X&Y parameter is true. If so, it exchanges 614 the values of the X_Increment and Y_Increment parameters, and exchanges 616 the values of the Logical_Screen_Width and Logical_Screen_Height parameters. Then, driver 208 determines 604 whether the Negate_X parameter is set to true. If so, it negates 606 the value of the X_Increment parameter. If driver 208 determines 608 that the Negate_Y parameter is true, it neagtes 610 the value of the Y_Increment parameter. After these modifications are made, the initialization routine is finished. The resulting X_Increment and Y_Increment parameters are noew properly set and will so remain until either display resolution or orientation mode is changed.

Whenever software application 200 running on computer 220 needs to display image 204 on the logical screen, application 200 puts image 204 in source memory 202 and sends operating system 206 a signal indicating where image 204 can be found, and where on the logical screen it should appear. Operating system 206 passes this information to driver 208. The procedure by which image 204 is transferred to display memory 212 is given in the flowcharts of FIGS. 7 and 8.

Figure 7:
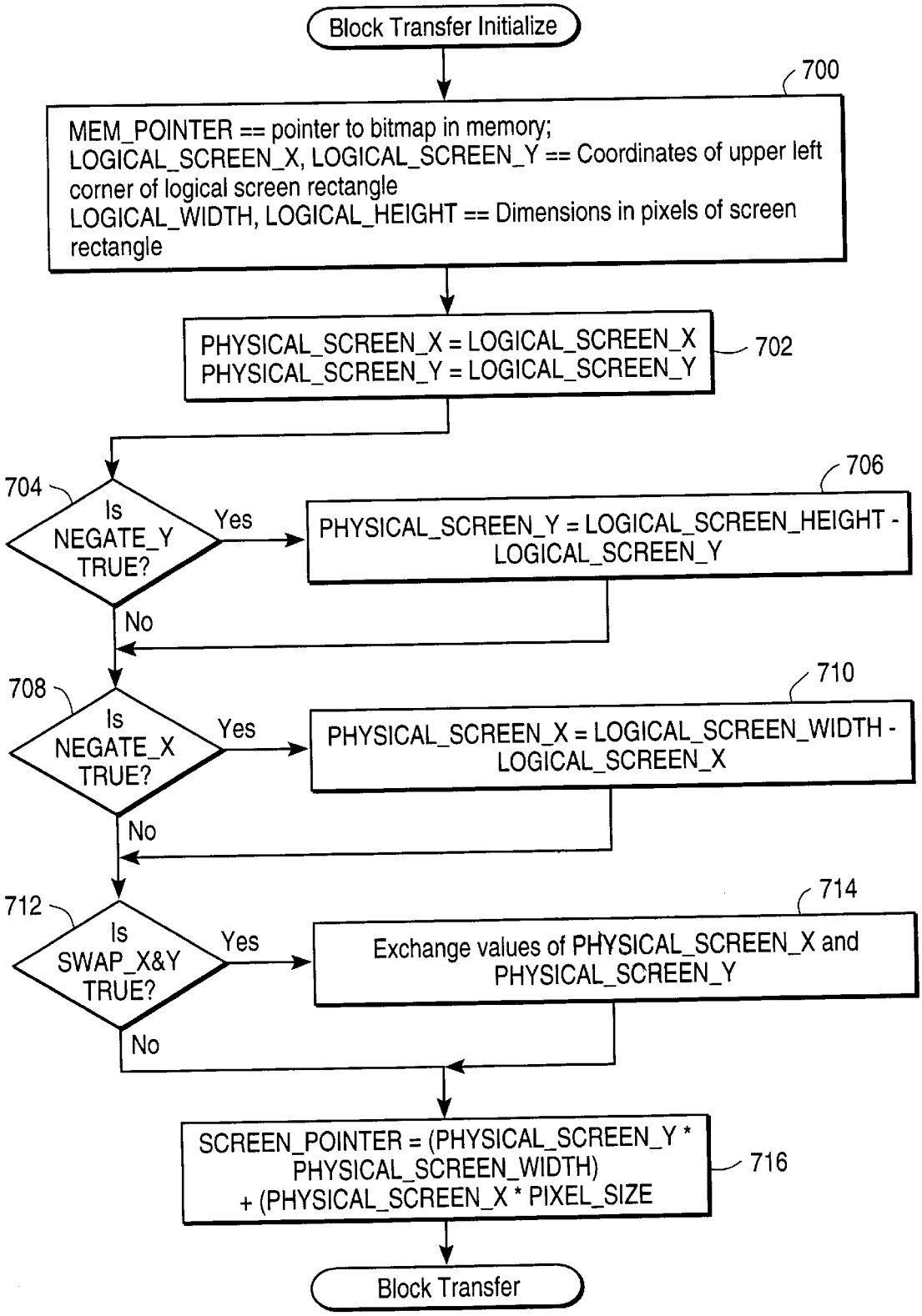

FIG. 7 is a flowchart of the block transfer initialization method used by driver 208 to prepare a number of parameters for the transfer of image information 204 from source memory 202 to display memory 212. These parameters rely on information specific to the transfer and cannot be calculated earlier, as can the X_Increment and Y_Increment parameters. Driver 208 receives 700 a Mem_Pointer parameter which specifies the first memory address of source memory 202 which is part of image 204. The pixel 304 of image 204 which is pointed to by the Mem_Pointer parameter is referred to herein as the "first pixel" of image 204. Logical_Screen_X and Logical_Screen_Y parameters specify the column and row location on the logical screen at which the first pixel of image 204 should be placed, and these parameters are received 700 from operating system 206. The Logical_Width and Logical_Height parameters, received from operating system 206, specify the width and height of image 204 in pixels 304. These five parameters are passed to driver 208 by operating system 206. Then, a Physical_Screen_X parameter is set 702 equal to the Logical_Screen_X parameter, and a Physical_Screen_Y parameter is set 702 equal to the Logical_Screen_Y parameter. The Physical_Screen_X and Physical_Screen_Y parameters will specify where on physical computer display 216 the first pixel of image 204 will appear. This location is the same as the position specified by the Logical_Screen_X and Logical_Screen_Y parameters when the standard mode is the active orientation mode.

Driver 208 determines 704 whether Negate_Y is true. If it is, the direction of the vertical axis is reversed, so it is necessary to recalculate 706 Physical_Screen_Y to be Logical_Screen_Height minus Logical_Screen_Y. Then, it is determined 708 whether Negate_X is true. If it is, the direction of the horizontal axis is reversed, and it is necessary to recalculate 710 Physical_Screen_X to be Logical_Screen_Width minus Logical_Screen_X. Finally, it is determined 712 whether Swap_X&Y is true. If it is, the horizontal and vertical axes need to be swapped, driver 208 exchanges 714 the values of Physical_Screen_X and Physical_Screen_Y. A Screen_Pointer parameter is then calculated 716 to be the sum of the product of Physical_Screen_Y multiplied by Physical_Screen_Width and the product of Physical_Screen_X multiplied by Pixel_Size. The Screen_Pointer parameter specifies the location within display memory 212 which is to receive the value of the first pixel of image 204. This pointer will be modified by the X_Increment and Y_Increment parameters while transferring image 204 data from source memory 202 to display memory 212, so each successive pixel 304 from image 204 is transferred to the proper location in display memory 212.

Figure 8:
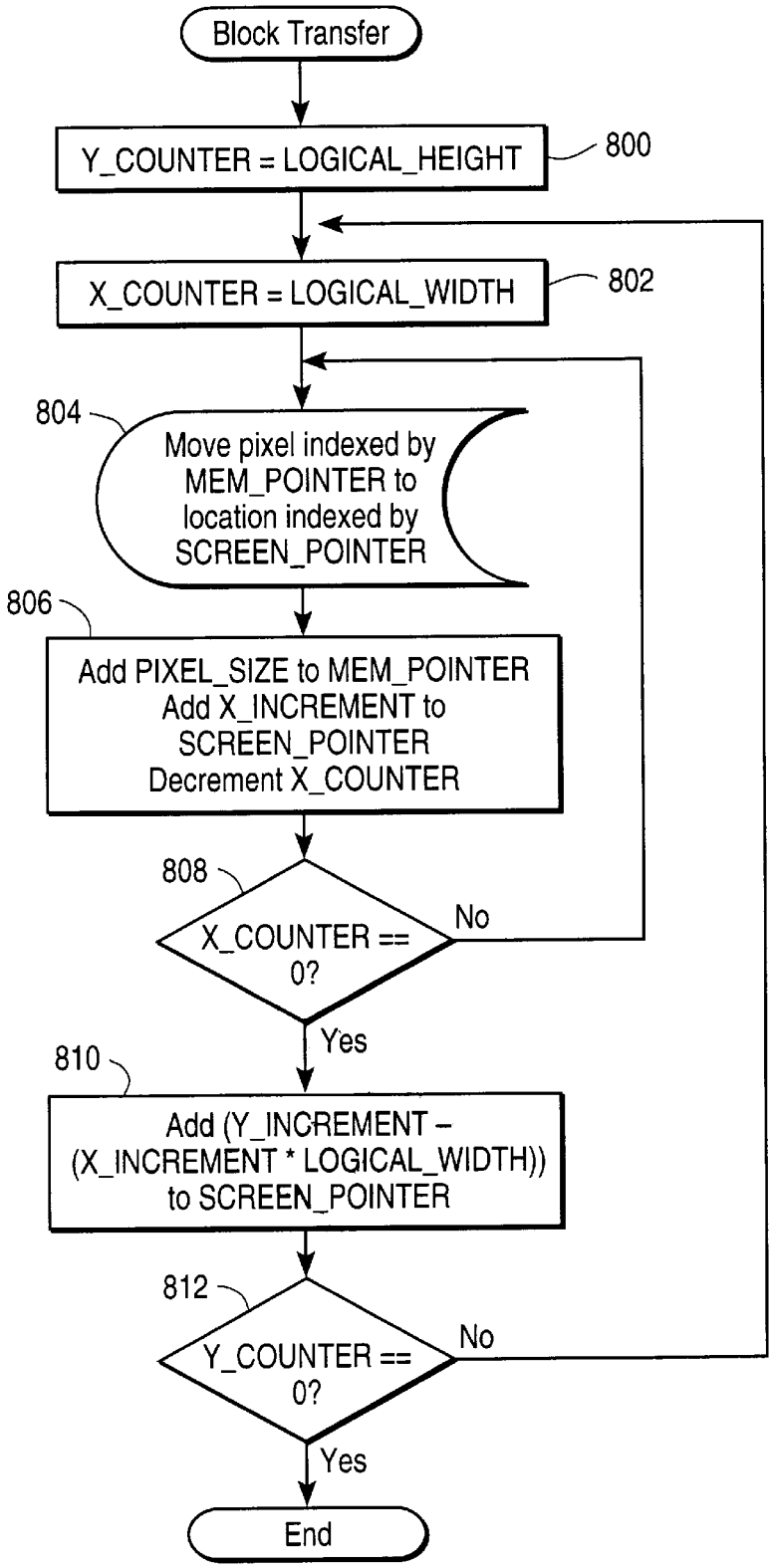

FIG. 8 is a flowchart of the process used by driver 208 for transferring image 204 from source memory 202 to display memory 212. First, a Y_Counter is set 800 to equal Logical_Height, and an X_Counter is set 802 to equal Logical_Width. These two counters are used by driver 208 to iterate through all of the pixels 304 of image 204 in source memory 202 one at a time. The Y_Counter holds the number of source image lines 302 which are left to be transferred. For the actual transfer of a pixel 304, driver 208 reads the pixel 304 value in source memory 202 which is pointed to by Mem_Pointer and writes 804 it into display memory 212 at the address indicated by Screen_Pointer. In alternate embodiments, driver 208 may do something other than simply copy the value from source memory 202 to display memory 212. For example, the value read out of source memory 202 may be logically combined with a mask, a pattern, or even the contents of display memory 212 before being written to display memory 212.

After the value has been written, driver 208 adds 806 Pixel_Size to Mem_Pointer, and adds 806 X_Increment to Screen_Pointer. X_Counter is also decreased 806 by one. This properly updates Mem_Pointer and Screen_Pointer as long as the last pixel 304 read was not the final pixel 304 in a source image line 302 in source memory 202.

Then, it is determined 808 whether the X_Counter has reached zero, indicating that all pixels 304 in a source image line 302 have been read. If it has not reached zero, execution continues above with the next pixel 304 transfer 804. If it has, then the last pixel 304 read was the final pixel 304 in a source image line 302 in source memory 202, and Y_Increment is added 810 to Screen_Pointer, and the product of X_Increment multiplied by Logical_Width is subtracted 810 from Screen_Pointer. The addition of Y_Increment updates Screen_Pointer to point to a location corresponding to the pixel 304 in source memory 202 which is one source image line 302 past than the last pixel. The subtraction of the product of X_Increment multiplied by Logical_Width updates Screen_Pointer to point to a location corresponding to the first pixel 304 of the new source image line 302. In alternate embodiments, Y_Increment is calculated prior to step 802 to include the subtraction of the product of X_Increment multiplied by Logical_Width, so only the addition of Y_Increment to Screen_Pointer is required. Doing this increases the execution speed of the pixel 304 transfer. Y_Counter is decreased 810 by one, to account for the fact that one more source image line 302 has been completed. If the subsequent source image line 302 does not immediately follow in source memory 202 the previous source image line 302, then Mem_Pointer is updated 810 as well.

Y_Counter is then tested 812 to determine whether it has reached zero, indicating that all source image lines 302 of image 204 have been transferred. If it has not reached zero, then execution continues above with X-Counter being reset 802 to Logical_Width. If Y_Counter has reached zero, then the block transfer routine is finished, and image 210 is complete.

The above description is included to illustrate the operation of an illustrative embodiment and is not meant to limit the scope of the invention. The scope of the invention is to be limited only by the following claims. From the above description, many variations will be apparent to one skilled in the art that would be encompassed by the spirit and scope of the present invention.

I claim:

1. A computer implemented method for transferring image information from a source memory to a display memory for presentation on a computer display, the image information comprising a plurality of image lines, each image line comprising a plurality of pixels, the transfer causing an image to be presented on the computer display conforming in orientation to one of a plurality of selectable orientations with respect to the computer display, the method comprising the steps of:

determining one of the plurality of selectable orientations as the selected orientation;

calculating a first increment parameter and a second increment parameter from the selected orientation; and stepping seriatim through each image line in the source memory, for each image line:

stepping seriatim through each pixel of the image line, for each pixel:

transferring the value of that pixel to a display memory location indicated by a display memory pointer; and updating the display memory pointer after each pixel transfer by adding the first increment parameter to the display memory pointer; and updating the display memory pointer after each image line by adding the second increment parameter to the display memory pointer.

2. The method of claim 1, wherein the plurality of selectable orientations include:

a first orientation in which the orientation of the image matches the orientation of the computer display;

a second orientation in which the image is rotated counterclockwise from the first orientation by 90 degrees;

a third orientation in which the image is rotated from the first orientation by 180 degrees; and a fourth orientation in which the image is rotated counterclockwise from the first orientation by 270 degrees.

3. The method of claim 2, wherein:

the display memory comprises a plurality of display lines, each display line comprising a plurality of display pixel memory locations; and the step of calculating the first increment parameter and the second increment parameter comprises:

responsive to the selected orientation being the first orientation, setting the first increment parameter to a value which is the memory size of a display pixel memory location and setting the second increment parameter to a value which is the memory size of a display line minus the product of the first increment parameter multiplied by the number of pixels in an image line;

responsive to the selected orientation being the second orientation, setting the first increment parameter to a value which is the negative of the memory size of a display line and setting the second increment parameter to a value which is the memory size of a display pixel memory location minus the product of the first increment parameter multiplied by the number of pixels in an image line;

responsive to the selected orientation being the third orientation, setting the first increment parameter to a value which is the negative of the memory size of a display pixel memory location and setting the second increment parameter to a value which is the negative of the memory size of a display line minus the product of the first increment parameter multiplied by the number of pixels in an image line; and responsive to the selected orientation being the fourth orientation, setting the first increment parameter to a value which is the memory size of a display line and setting the second increment parameter to a value which is the negative of the memory size of a display memory location minus the product of the first increment parameter multiplied by the number of pixels in an image line.

4. The method of claim 2, further comprising the steps of:

responsive to the selected orientation being the first orientation, setting a Negate_X parameter, having a first state and a second state, to the first state, setting a Negate_Y parameter, having a first state and a second state, to the first state, and setting a Swap parameter, having a first state and a second state, to the first state;

responsive to the selected orientation being the second orientation, setting the Negate_Y parameter to the first state, setting the Negate_X parameter to the second state, and setting the Swap parameter to the second state;

responsive to the selected orientation being the third orientation, setting the Negate_X parameter to the second state, setting the Negate_Y parameter to the second state, and setting the Swap parameter to the first state; and responsive to the selected orientation being the fourth orientation, setting the Negate_Y parameter to the second state, setting the Negate_X parameter to the first state, and setting the Swap parameter to the second state.

5. The method of claim 4, wherein:

the display memory comprises a plurality of display lines, each display line comprising a plurality of display pixel memory locations; and the step of calculating the first increment parameter and the second increment parameter comprises:

setting the first increment parameter to a value which is the memory size of a display pixel memory location;

setting the second increment parameter to a value which is the memory size of a display line;

responsive to the Swap parameter being set to the second state, exchanging the values of the first increment parameter and the second increment parameter;

responsive to the Negate_X parameter being set to the second state, negating the value of the first increment parameter;

responsive to the Negate_Y parameter being set to the second state, negating the value of the second increment parameter; and subtracting from the second increment parameter the product of the first increment parameter multiplied by the number of pixels in an image line.

6. The method of claim 2, wherein the plurality of selectable orientations include:

a fifth orientation which is a horizontal reflection of the first orientation;

a sixth orientation in which a horizontal reflection of the first orientation is rotated counterclockwise by 90 degrees;

a seventh orientation in which a horizontal reflection of the first orientation is rotated by 180 degrees; and an eighth orientation in which a horizontal reflection of the first orientation is rotated counterclockwise by 270 degrees.

7. The method of claim 6, wherein:

the display memory comprises a plurality of display lines, each display line comprising a plurality of display pixel memory locations; and the step of calculating the first increment parameter and the second increment parameter comprises:

responsive to the selected orientation being the first orientation, setting the first increment parameter to a value which is the memory size of a display pixel memory location and setting the second increment parameter to a value which is the memory size of a display line minus the product of the first increment parameter multiplied by the number of pixels in an image line;

responsive to the selected orientation being the second orientation, setting the first increment parameter to a value which is the negative of the memory size of a display line and setting the second increment parameter to a value which is the memory size of a display pixel memory location minus the product of the first increment parameter multiplied by the number of pixels in an image line;

responsive to the selected orientation being the third orientation, setting the first increment parameter to a value which is the negative of the memory size of a display pixel memory location and setting the second increment parameter to a value which is the negative of the memory size of a display line minus the product of the first increment parameter multiplied by the number of pixels in an image line;

responsive to the selected orientation being the fourth orientation, setting the first increment parameter to a value which is the memory size of a display line and setting the second increment parameter to a value which is the negative of the memory size of a display memory location minus the product of the first increment parameter multiplied by the number of pixels in an image line;

responsive to the selected orientation being the fifth orientation, setting the first increment parameter to a value which is the negative of the memory size of a display pixel memory location and setting the second increment parameter to a value which is the memory size of a display line minus the product of the first increment parameter multiplied by the number of pixels in an image line;

responsive to the selected orientation being the sixth orientation, setting the first increment parameter to a value which is the memory size of a display line and setting the second increment parameter to a value which is the memory size of a display pixel memory location minus the product of the first increment parameter multiplied by the number of pixels in an image line;

responsive to the selected orientation being the seventh orientation, setting the first increment parameter to a value which is the memory size of a display pixel memory location and setting the second increment parameter to a value which is the negative of the memory size of a display line minus the product of the first increment parameter multiplied by the number of pixels in an image line; and responsive to the selected orientation being the eighth orientation, setting the first increment parameter to a value which is the negative of the memory size of a display line and setting the second increment parameter to a value which is the negative of the memory size of a display memory location minus the product of the first increment parameter multiplied by the number of pixels in an image line.

8. The method of claim 6, further comprising the steps of:

responsive to the selected orientation being the first orientation, setting a Negate_X parameter, having a first state and a second state, to the first state, setting a Negate_Y parameter, having a first state and a second state, to the first state, and setting a Swap parameter, having a first state and a second state, to the first state;

responsive to the selected orientation being the second orientation, setting the Negate_Y parameter to the first state, setting the Negate_X parameter to the second state, and setting the Swap parameter to the second state;

responsive to the selected orientation being the third orientation, setting the Negate_X parameter to the second state, setting the Negate_Y parameter to the second state, and setting the Swap parameter to the first state;

responsive to the selected orientation being the fourth orientation, setting the Negate_Y parameter to the second state, setting the Negate_X parameter to the first state, and setting the Swap parameter to the second state;

responsive to the selected orientation being the fifth orientation, setting the Negate_Y parameter to the first state, setting the Negate_X parameter to the first state, and setting the Swap parameter to the first state;

responsive to the selected orientation being the sixth orientation, setting the Negate_X parameter to the first state, setting the Negate_Y parameter to the first state, and setting the Swap parameter to the second state;

responsive to the selected orientation being the seventh orientation, setting the Negate_Y parameter to the first state, setting the Negate_X parameter to the second state, and setting the Swap parameter to the first state; and responsive to the selected orientation being the eighth orientation, setting the Negate_X parameter to the second state, setting the Negate_Y parameter to the second state, and setting the Swap parameter to the second state.

9. The method of claim 8, wherein:

the display memory comprises a plurality of display lines, each display line comprising a plurality of display pixel memory locations; and the step of calculating the first increment parameter and the second increment parameter comprises:

setting the first increment parameter to a value which is the memory size of a display pixel memory location;

setting the second increment parameter to a value which is the memory size of a display line;

responsive to the Swap parameter being set to the second state, exchanging the values of the first increment parameter and the second increment parameter;

responsive to the Negate_X parameter being set to the second state, negating the value of the first increment parameter;

responsive to the Negate_Y parameter being set to the second state, negating the value of the second increment parameter; and subtracting from the second increment parameter the product of the first increment parameter multiplied by the number of pixels in an image line.

10. The method of claim 1, wherein transferring the value of a pixel to the display memory comprises substituting a source memory pixel value for a display memory pixel value.

11. The method of claim 1, wherein transferring the value of a pixel to the display memory comprises substituting for a display memory pixel value the result of a logical operation on a source memory pixel value and a mask.

12. The method of claim 1, wherein transferring the value of a pixel to the display memory comprises substituting for a display memory pixel value the result of a logical operation on a source memory pixel value and the display memory pixel value.

13. A system for presenting an image on a computer display such that the image conforms in orientation to one of a plurality of selectable orientations with respect to the computer display, the system comprising:

a source memory for storing source image information, the source image information corresponding to the image and comprising a plurality of image lines, each image line comprising a plurality of pixels;

a display memory for storing display image information, the display memory being coupled to the computer display such that the computer display presents an image which corresponds to the display image information; and a driver module coupled to the source memory and the display memory, for:

receiving parameters specifying a selected one of the plurality of selectable orientations as a selected orientation;

receiving a display memory pointer specifying a memory location in the display memory;

calculating a first increment parameter and a second increment parameter from the parameters specifying the selected orientation;

stepping seriatim through each image line in the source memory, for each image line:

stepping seriatim through each pixel of the image line, for each pixel:

transferring the value of that pixel to a display memory location indicated by a display memory pointer; and updating the display memory pointer after each pixel transfer by adding the first increment parameter to the display memory pointer; and updating the display memory pointer after each line by adding the second increment parameter to the display memory pointer.

14. The system of claim 13, wherein the plurality of selectable orientations include:

a first orientation in which the orientation of the image matches the orientation of the computer display;

a second orientation in which the image is rotated counterclockwise from the first orientation by 90 degrees;

a third orientation in which the image is rotated from the first orientation by 180 degrees; and a fourth orientation in which the image is rotated counterclockwise from the first orientation by 270 degrees.

15. The system of claim 14, wherein:

the display memory comprises a plurality of display lines, each display line comprising a plurality of display pixel memory locations; and the driver module calculates the first increment parameter and the second increment parameter by:

responsive to the selected orientation being the first orientation, setting the first increment parameter to a value which is the memory size of a display pixel memory location and setting the second increment parameter to a value which is the memory size of a display line minus the product of the first increment parameter multiplied by the number of pixels in an image line;

responsive to the selected orientation being the second orientation, setting the first increment parameter to a value which is the negative of the memory size of a display line and setting the second increment parameter to a value which is the memory size of a display pixel memory location minus the product of the first increment parameter multiplied by the number of pixels in an image line;

responsive to the selected orientation being the third orientation, setting the first increment parameter to a value which is the negative of the memory size of a display pixel memory location and setting the second increment parameter to a value which is the negative of the memory size of a display line minus the product of the first increment parameter multiplied by the number of pixels in an image line; and responsive to the selected orientation being the fourth orientation, setting the first increment parameter to a value which is the memory size of a display line and setting the second increment parameter to a value which is the negative of the memory size of a display memory location minus the product of the first increment parameter multiplied by the number of pixels in an image line.

16. The system of claim 13, wherein transferring the value of a pixel to the display memory comprises substituting a source memory pixel value for a display memory pixel value.

17. The system of claim 13, wherein transferring the value of a pixel to the display memory comprises substituting for a display memory pixel value the result of a logical operation on a source memory pixel value and a mask.

18. The system of claim 13, wherein transferring the value of a pixel to the display memory comprises substituting for a display memory pixel value the result of a logical operation on a source memory pixel value and the display memory pixel value.

19. A software product, comprising:

a computer-readable medium storing program code for transferring image information from a source memory to a display memory for presentation on a computer display, the image information comprising a plurality of image lines, each image line comprising a plurality of pixels, the transfer causing an image to be presented on the computer display conforming in orientation to one of a plurality of selectable orientations with respect to the computer display, the program code, when executed by a processor, causing the processor to perform the steps of:

receiving parameters specifying one of the plurality of selectable orientations as the selected orientation;

calculating a first increment parameter and a second increment parameter from the selected orientation; and stepping seriatim through each image line in the source memory, for each image line:

stepping seriatim through each pixel of the image line, for each pixel:

transferring the value of that pixel to a display memory location indicated by a display memory pointer; and updating the display memory pointer after each pixel transfer by adding the first increment parameter to the display memory pointer; and updating the display memory pointer after each line by adding the second increment parameter to the display memory pointer.

20. The software product of claim 19, wherein the plurality of selectable orientations include:

a first orientation in which the orientation of the image matches the orientation of the computer display;

a second orientation in which the image is rotated counterclockwise from the first orientation by 90 degrees;

a third orientation in which the image is rotated from the first orientation by 180 degrees; and a fourth orientation in which the image is rotated counterclockwise from the first orientation by 270 degrees.

21. The software product of claim 20, wherein the display memory comprises a plurality of display lines, each display line comprising a plurality of display pixel memory locations, and the step of calculating the first increment parameter and the second increment parameter comprises:

responsive to the selected orientation being the first orientation, setting the first increment parameter to a value which is the memory size of a display pixel memory location and setting the second increment parameter to a value which is the memory size of a display line minus the product of the first increment parameter multiplied by the number of pixels in an image line;

responsive to the selected orientation being the second orientation, setting the first increment parameter to a value which is the negative of the memory size of a display line and setting the second increment parameter to a value which is the memory size of a display pixel memory location minus the product of the first increment parameter multiplied by the number of pixels in an image line;

responsive to the selected orientation being the third orientation, setting the first increment parameter to a value which is the negative of the memory size of a display pixel memory location and setting the second increment parameter to a value which is the negative of the memory size of a display line minus the product of the first increment parameter multiplied by the number of pixels in an image line; and responsive to the selected orientation being the fourth orientation, setting the first increment parameter to a value which is the memory size of a display line and setting the second increment parameter to a value which is the negative of the memory size of a display memory location minus the product of the first increment parameter multiplied by the number of pixels in an image line.

22. The software product of claim 19, wherein transferring the value of a pixel to the display memory comprises substituting a source memory pixel value for a display memory pixel value.

23. The software product of claim 19, wherein transferring the value of a pixel to the display memory comprises substituting for a display memory pixel value the result of a logical operation on a source memory pixel value and a mask.

24. The software product of claim 19, wherein transferring the value of a pixel to the display memory comprises substituting for a display memory pixel value the result of a logical operation on a source memory pixel value and the display memory pixel value.

* * * * *